US008910978B2

(12) United States Patent
Hochreiter et al.

(10) Patent No.: US 8,910,978 B2
(45) Date of Patent: Dec. 16, 2014

(54) BINDING SYSTEM USING CONCENTRIC CYLINDERS

(71) Applicants: Eric Peschan Hochreiter, Rochester, NY (US); Alex David Horvath, Fairport, NY (US); Jose E. Rivera, Rochester, NY (US)

(72) Inventors: Eric Peschan Hochreiter, Rochester, NY (US); Alex David Horvath, Fairport, NY (US); Jose E. Rivera, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 67 days.

(21) Appl. No.: 13/769,868

(22) Filed: Feb. 19, 2013

(65) Prior Publication Data

US 2014/0232096 A1 Aug. 21, 2014

(51) Int. Cl.
*B42D 17/00* (2006.01)
*B42D 1/00* (2006.01)

(52) U.S. Cl.
CPC ..... *B42D 1/00* (2013.01)
USPC ..... 281/48; 281/46; 281/47

(58) Field of Classification Search
CPC .... B42F 15/0035; B42F 15/063; B42D 17/00
USPC ..... 281/46–48
See application file for complete search history.

(56) References Cited

U.S. PATENT DOCUMENTS 402,024 A * 4/1889 Lomas ..... 281/47
486,316 A * 11/1892 Wright ..... 281/47
1,654,191 A 12/1927 Fedies et al.
1,736,908 A 11/1929 Franey
3,866,274 A 2/1975 Malavazos
4,175,880 A 11/1979 Muller
5,061,139 A 10/1991 Zoltner
5,074,696 A 12/1991 Tanaka
5,690,443 A 11/1997 Sullivan
5,716,181 A 2/1998 Ebel
5,791,692 A 8/1998 Manico
5,957,502 A 9/1999 Manico et al.
6,004,061 A 12/1999 Manico (Continued)

FOREIGN PATENT DOCUMENTS

CH 122365 * 10/1928
CH 253023 * 2/1948

(Continued)

OTHER PUBLICATIONS

Posterhanger—How It Works, http://posterhanger.com/howitworks.html.

*Primary Examiner* — Kyle Grabowski
(74) *Attorney, Agent, or Firm* — Kevin E. Spaulding

(57) ABSTRACT

A binding system for binding a set of media sheets, including a cylinder having an outer diameter and a length, and a retainer fabricated from a flexible material. The retainer has an arc-shaped cross-section having an inner diameter and an associated arc angle thereby providing an opening slot that extends along a length of the retainer. The binding system is adapted to bind the set of media sheets by wrapping the media sheets around the cylinder and inserting the wrapped cylinder into the retainer with the wrapped media sheets extending out of the opening slot in the retainer. The inner diameter of the retainer is less than the sum of the outer diameter of the cylinder and a total thickness of the wrapped media sheets so that the retainer flexes to provide a clamping force to bind the media sheets.

15 Claims, 12 Drawing Sheets

(56) References Cited

U.S. PATENT DOCUMENTS

| | | | | |
|---|---|---|---|---|
| 6,076,687 | A * | 6/2000 | Huang | 211/124 |
| 6,742,809 | B2 | 6/2004 | Frosig et al. | |
| 7,047,683 | B2 | 5/2006 | Austin | |
| 7,757,358 | B2 | 7/2010 | Hoarau et al. | |
| 7,798,736 | B2 | 9/2010 | Hoarau et al. | |
| 2012/0248753 | A1 | 10/2012 | Mindler | |
| 2012/0251269 | A1 | 10/2012 | Mindler | |

FOREIGN PATENT DOCUMENTS

| | | | |
|---|---|---|---|
| DE | 466867 | * | 5/1927 |
| EP | 2110264 | * | 10/2009 |
| FR | 2668981 | | 11/1990 |
| FR | 2843912 | * | 3/2004 |
| GB | 216 299 | | 5/1924 |
| WO | WO03066347 | * | 8/2003 |

* cited by examiner

BINDING SYSTEM USING CONCENTRIC CYLINDERS

CROSS-REFERENCE TO RELATED APPLICATIONS

Reference is made to commonly assigned, co-pending U.S. patent application Ser. No. 13/769,880, entitled: "Binding system using binder pieces with concentric cylinders", by Hochreiter et al.; to commonly assigned, co-pending U.S. patent application Ser. No. 13/769,898, entitled: "Binding system using arc-shaped retainer", by Hochreiter et al.; to commonly assigned, co-pending U.S. patent application Ser. No. 13/769,911, entitled: "Binding system using a retainer clip", by Hochreiter; to commonly assigned, co-pending U.S. patent application Ser. No. 13/769,937, entitled: "Binding system using one-piece retainer clip", by Hochreiter; and to commonly assigned, co-pending U.S. patent application Ser. No. 13/769,923, entitled: "Binding system using two binding pieces", by Hochreiter, each of which is incorporated herein by reference.

FIELD OF THE INVENTION

This invention pertains to the field of book binding and more particularly to a system for binding a set of sheets for a photo book.

BACKGROUND OF THE INVENTION

In recent years, the proliferation of digital photography has provided consumers with a variety of options to store and use captured images. These options include various "soft copy" methods involving memory cards, memory sticks, CD's, DVD's, hard drives, on-line storage etc. These "soft-copy" options, while providing the environmental benefit of eliminating the paper, ink or dye, and other chemicals required for "hard-copy" output, are potentially less secure for long term storage due to media format obsolescence, storage media physical or chemical breakdown, and on-line storage companies disappearing. A variety of options exist for customers to print digital images, including conventional silver halide processing, ink jet, thermal dye transfer, and electrophotographic methods. These "hard-copy" methods are capable of providing printed output which can last for many decades. Although customers can make such "hard-copy" prints at home, modern retail outlets provide kiosks and order-terminals where both prints and additional services can be requested and provided. Similar services are also available from on-line companies such as Shutterfly. An increasingly popular service provides photo albums or photo books with collections of images associated with a specific event, such as a vacation, family gathering, school function etc. The photo books are composed of printed images produced by any one of the printing methodologies described above that are bound together in book form.

Photo books can be constructed in various formats. For example, single sheets of printed material bearing an image on one side of the material can be bound together to form the photo books. Such photo books are generally less preferred as each printed page of the book will face a blank page (i.e. the non-printed backside of another printed page). This disadvantage can be eliminated by adhering together sheets of single-side printed media to produce a double-sided album page as disclosed in U.S. Pat. No. 5,791,692, U.S. Pat. No. 5,957,502, U.S. Pat. No. 6,004,061 and U.S. Pat. No. 7,047,683. U.S. Pat. No. 6,742,809 describes a strip of images folded in accordion manner such that each pair of adjacent images forms two sides of a page, the accordion folds being adhered together on the inside. Photo books produced by adhering two imaged prints together are typically thicker than single-sided sheet products, and this can result in a heavy and bulky product when the photo book contains a large number of pages.

The pages of printed images can be bound together in a variety of different ways to fabricate the photo books. Techniques known in the art for constructing photo books include binding the pages together using binder clips, staples, adhesive, stitching or ring binders. These methods vary widely in the attractiveness and durability of the resulting photo book, as well as the equipment and operator skill level required during the fabrication process. Generally, the methods to produce the most attractive and durable photo books have required expensive components or complex binding equipment operated by highly-trained operators. This has made it impractical to produce photo books in retail environments that offer photo printing services using photo kiosks.

U.S. Pat. No. 5,061,139 to Zoltner, entitled "Method for applying hard and soft covers to bound or unbound documents," discloses a bindery system for applying hard or soft covers to form bound books. The system includes a metal U-shaped channel which is bonded to the inside spine surface of the cover. Specialized equipment is used to crimp the U-shaped channel to bind the book pages.

A number of different binding systems have been proposed that utilize spring clamp mechanisms. U.S. Pat. No. 5,716,181 to Ebel, entitled "One piece self-binding system for binding documents," discloses a binding system for use in a home environment that utilizes a spring binding to clamp pages into a bound book. A retaining piece is provided to hold the spring binding open until the pages are in place. The retaining piece is removed to clamp the pages into the book cover. U.S. Pat. No. 7,757,358 to Hoarau et al., entitled "Sheet retention mechanisms for spring clamp binders," discloses a system for binding pages together using a spring clamp mechanism. U.S. Pat. No. 7,798,736 to Hoarau et al., entitled "Media binder arrangements," discloses a media binder that includes spine clamps for securing the media pages. A tension sheet is used to transmit an opening force to the spine clamp. The components of such systems are generally too expensive and complex to be useful for producing low-cost photo books in a retail environment.

U.S. Pat. No. 3,866,274 to Malavazos et al., entitled "Device for binding sheets," discloses a device for binding a plurality sheets that comprise a pair of identical binding members, each of which includes a base member and a plurality of binding posts. The binding posts are inserted through apertures on the other binding member. Each binding post has a continuous series of ratchet teeth adapted to engage with the ratchet teeth on a corresponding binding post on the other binding member. This approach has the disadvantage that after the binding pieces are assembled, a cutting device must be used to shave off the portion of the binding posts that protrude from the outer face of the base members.

U.S. Pat. No. 5,690,443 to Sullivan et al., entitled "Adjustable, releasable binding fastener," discloses a fastening device having male and female fastener portions for binding a stack of paper. The female fastener portion includes a planar base having an aperture and an arcuate shaped collar with ratchet teeth facing the aperture on two opposing sides. The male fastener portion includes a post extending perpendicularly from a planar base. The post includes ratchet teeth adapted to engage with the ratchet teeth on the female fastening device when the post is inserted into the collar.

French patent document FR2668981A1 to Bourdarias discloses a device for assembling sheets into a packet. It comprises a pair of identical pegs, each having one side formed into a series of teeth. The pegs are designed to be inserted head-to-tail in a hole running through the sheets, the toothed sides being placed against each other. The total cross-section of the two juxtaposed pegs fits closely inside that of the hole. Each peg has a head which stops against one side of the packet.

There remains for a low-cost method to bind a set of sheets to form an attractive and durable photo book without the need for special purpose equipment or highly-trained operators.

SUMMARY OF THE INVENTION

The present invention represents a binding system, comprising: a cylinder having an outer diameter and a length; and a retainer having an arc-shaped cross-section fabricated from a flexible material, the arc-shaped cross-section having an inner diameter and an associated arc angle of at least 200 degrees and less than 360 degrees thereby providing an opening slot that extends along a length of the retainer;

wherein the cylinder and the retainer are adapted to bind a set of media sheets by wrapping the media sheets around the cylinder and inserting the wrapped cylinder into the retainer with the wrapped media sheets extending out of the opening slot in the retainer;

and wherein the retainer flexes to provide a clamping force to bind the set of media sheets when the wrapped cylinder is inserted into the retainer.

This invention has the advantage that is a simple, low-cost method to create a photo book utilizing simple parts that can be easily assembled by unskilled operators in a retail environment, or can be purchased by a consumer and assembled at home.

It has the additional advantage that no specialized equipment or adhesives are required to assemble the photo book.

It is to be understood that the attached drawings are for purposes of illustrating the concepts of the invention and may not be to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Commonly-assigned U.S. Patent Application Publication No. 2012/0248753 to Mindler, entitled "Binder clip," and the related U.S. Patent Application Publication No. 2012/0251269 to Mindler, entitled "Binder clip," both of which are incorporated herein by reference, describe a binding system that can be used to bind printed media sheets into a book (e.g., a photo book). The binding system includes a binder clip having flexible sidewalls biased to close around a rigid retainer for securing pages wrapped around the retainer or pinched by the binder clip and retainer to manually form a book.

Figure 1:
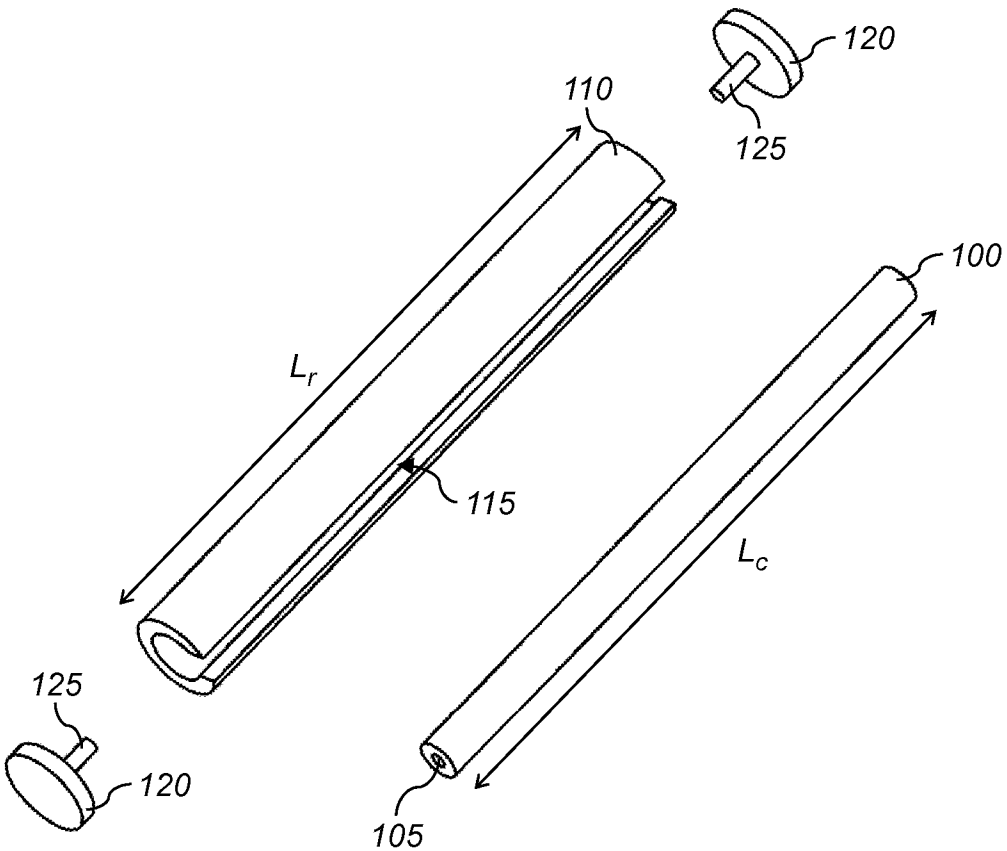
FIG. 1 shows the components of a binding system according to a first embodiment.
Figure 2A:
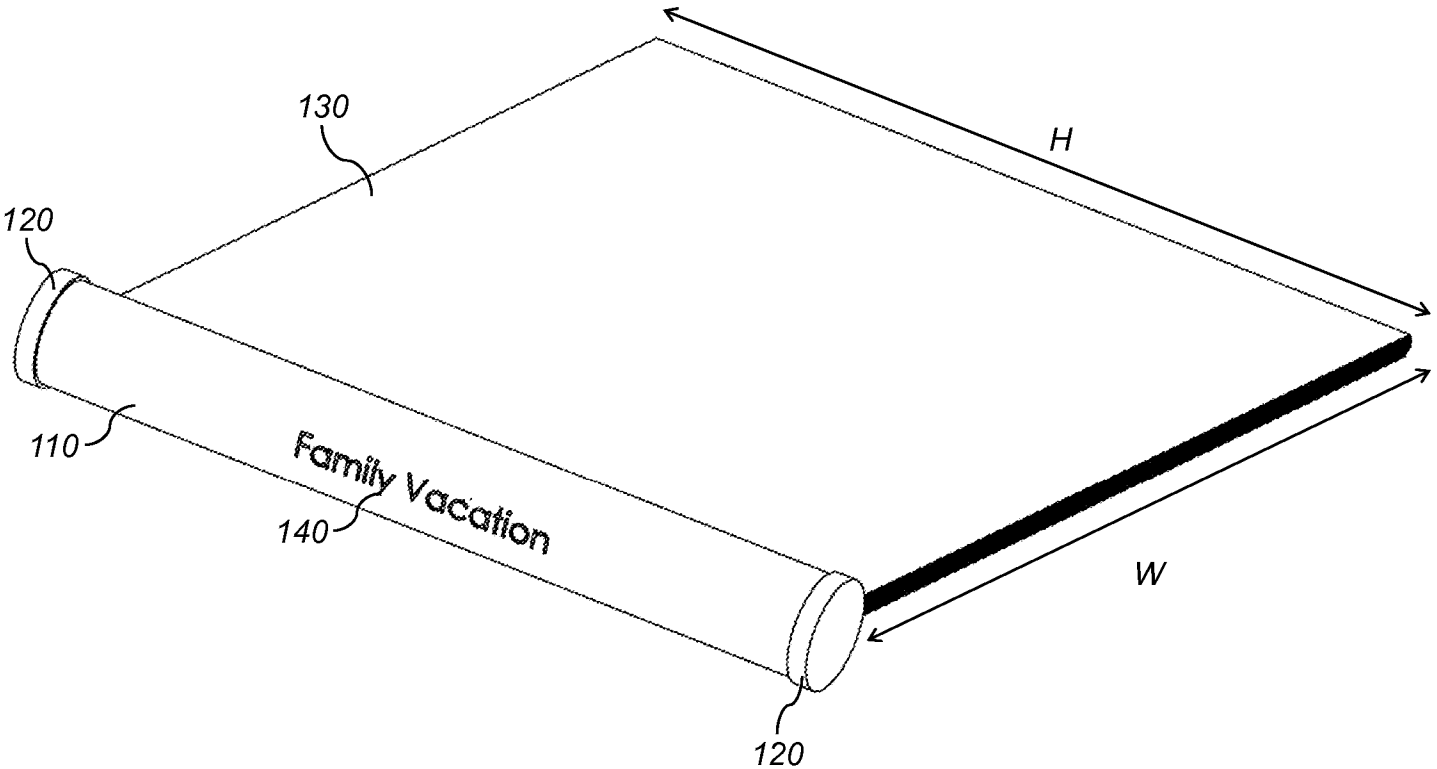
FIG. 2A shows the components of the binding system of FIG. 1 assembled to bind a set of sheets.

FIGS. 1, 2A-2B, 3A-3B and 4A-4B illustrate a binding system according to a first embodiment of the present invention. The binding system includes a cylinder 100 and a retainer 110 having a hollow center an opening slot 115. The binding system is adapted to bind a set of media sheets 130 by wrapping the media sheets 130 around the cylinder 100 and inserting the wrapped cylinder 100 into the retainer 110 with the wrapped media sheets 130 extending out of the opening slot 115 in the retainer 110 as shown in FIG. 2A. The wrapped cylinder 100 can either be inserted into the retainer 110 by sliding it into the hollow center of the retainer 110 from one end, or the wrapped cylinder 100 can be pushed through the opening slot in the retainer 110. In the second case, the opening slot 115 must be large enough so that the retainer 110 can flex sufficiently such that the wrapped cylinder 100 can fit through the resulting enlarged opening slot 115.

Figure 3B:
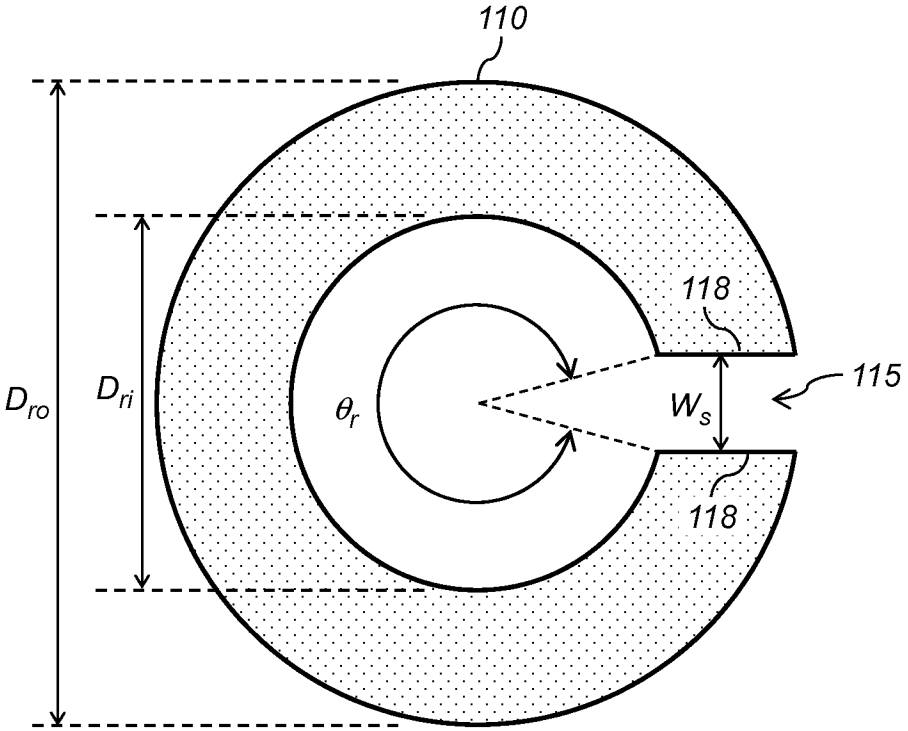
FIG. 3B shows a cross-section through the retainer of FIG. 1.
Figure 3A:
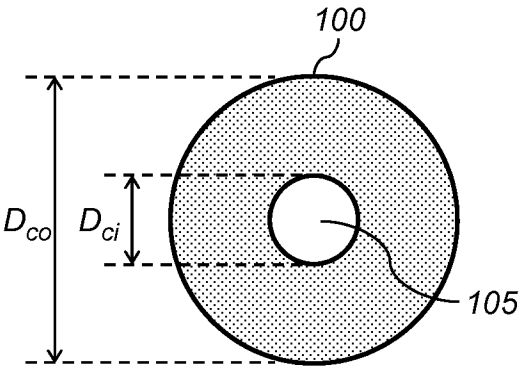
FIG. 3A shows a cross-section through the cylinder of FIG. 1.

The cylinder 100 has a cylinder length $L_c$ (see FIG. 1) and a cylinder outer diameter $D_{co}$ (see the cross-sectional view in FIG. 3A). In some embodiments, the cylinder 100 has a hollow core 105 with a cylinder inner diameter $D_{ci}$. In some embodiments, the hollow core 105 can extend all the way through the cylinder 100. In other embodiments, only the ends of the cylinder 100 are hollow. In some embodiments, the cylinder 100 can be fabricated using a plastic molded or extruded material such as ABS/Polycarbonate blends, or Poly Vinyl Chloride (PVC), or equivalents.

The retainer 110 has a retainer length $L_r$ (see FIG. 1) and an arc-shaped cross-section (see the cross-sectional view in FIG. 3B), thereby providing the opening slot 115 having a slot width $W_s$. The retainer 110 is preferably fabricated from a flexible material such as molded or extruded plastic (e.g., ABS/Polycarbonate blends, or Poly Vinyl Chloride (PVC), or equivalents). An arc is generally defined to be a portion of the circumference of a circle. Within the context of the present disclosure, an arc-shaped cross-section corresponds to a portion (i.e., a segment) of a circular ring. Accordingly, the retainer 100 corresponds to a portion (i.e., a segment) of a hollow cylinder.

In a preferred embodiment, the retainer length $L_r$ and the cylinder length $L_c$ are substantially equal to each other and to a height H of the book pages (i.e., the height of the media sheets 130). The arc-shaped cross-section of the retainer 110 has a retainer outer diameter $D_{ro}$, a retainer inner diameter $D_{ri}$, and an associated retainer arc angle $\theta_r$ (see the cross-sectional view in FIG. 3B). The retainer arc angle $\theta_r$ should generally be between 200°-360°, thereby forming the opening slot 115. The bound media sheets 130 form a book having book pages with a height H and a width W.

The opening slot 115 has slot edges 118. In the illustrated embodiment, the slot edges 118 are parallel to each other. In other embodiments, the slot edges 118 can take a variety of different forms. For example, the slot edges 118 can be along radial lines extending out from the center of the circular arc. Alternately, the slot edges can be rounded or beveled.

In an exemplary embodiment, cylinder length and the retainer length are $L_c$=$L_r$=101.6 mm, for binding media sheets with a height H=101.6 mm (i.e., 4 inches); the cylinder outer diameter $D_{co}$=6.4 mm; the cylinder inner diameter $D_{ci}$=3.3 mm; the retainer outer diameter $D_{ro}$=13.0 mm; the retainer inner diameter $D_{ri}$=8.6 mm, and the retainer slot width $W_s$=4.6 mm (corresponding to a retainer arc angle $\theta_r \approx 295°$). These dimensions have been found to provide good results for binding between 2 to 8 typical media sheets 130 of 148 gsm (g/m$^2$) material, with an additional media sheet 130 acting as a front and rear cover made from a thicker/stiffer 270 gsm material. It will be obvious to those skilled in the art that these parameters can be adjusted for various applications to accommodate different media sizes and thicknesses and different numbers of media sheets 130. In some embodiments, a number of different cylinders 100 having different cylinder outer diameters can be provided for use with the same retainer 110 in order to accommodate different numbers of media sheets 130.

Figure 4A:
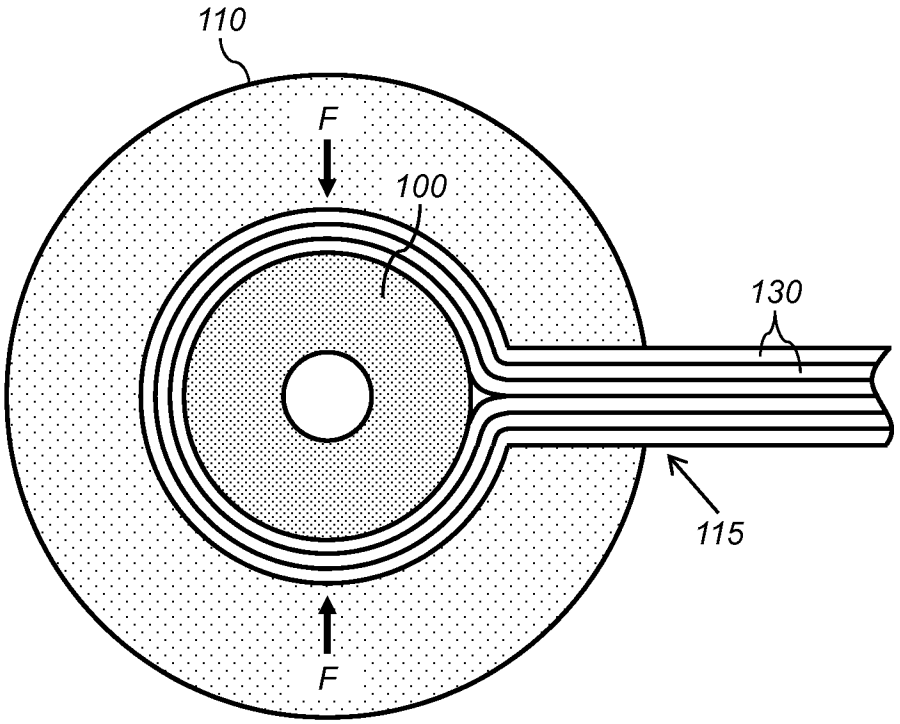
FIG. 4A shows a cross-section through the assembled binding system of FIG. 2A in a configuration where two ends of each sheet extend out of the opening slot of the retainer.

FIG. 4A show cross-sections through the assembled binding system of FIG. 2A in a configuration where two ends of each media sheet 130 extend out of the opening slot 115 of the retainer 110. In this case, the center of the media sheets 130 are preferably wrapped around the cylinder so that the two ends that extend out of the opening slot 115 have substantially the same length. In this way, each media sheet 130 forms two double-sided pages of the bound book. (In cases where the media sheets 130 are produced on a simplex printer rather than a duplex printer, the book pages will be single-sided rather than double sided.) The pages have a width W, which is slightly less than half of the width of the media sheets 130.

Figure 4B:
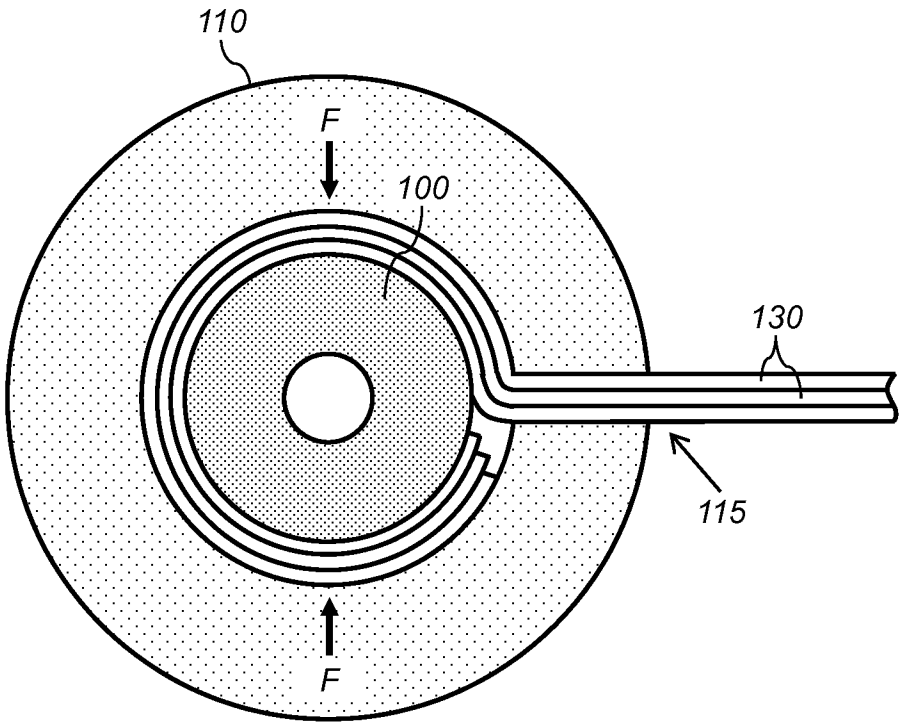
FIG. 4B shows a cross-section through the assembled binding system of FIG. 2A in a configuration where one end of each sheet extend out of the opening slot of the retainer.

FIG. 4B shows an alternate configuration where only one end of each media sheet 130 extend out of the opening slot 115 of the retainer 110. In this case, the media sheets 130 are wrapped around the cylinder 100 near one end of the media sheets 130 such that the ends remain inside the retainer 110. In this way, each media sheet 130 forms one double-sided page of the bound book. The pages have a width W, which is slightly less than the width of the media sheets 130.

The retainer inner diameter $D_{ri}$ should be chosen so that the retainer 110 provides a clamping force F to bind the set of media sheets 130 when it is in a flexed position around the wrapped cylinder 100. Nominally, when the retainer 110 is in a relaxed state, the retainer inner diameter $D_{ri}$ should be somewhat less than the sum of the cylinder outer diameter $D_{co}$ and a total thickness of the wrapped media sheets 130 so that the retainer 110 will be in a flexed position around the wrapped cylinder 100. This constraint can be relaxed somewhat due to the fact that the stiffness of the media sheets 130 will cause them to resist bending where they exit the opening slot 115. This can provide a clamping force on the media sheets 130 even when the retainer inner diameter $D_{ri}$ is somewhat larger than the sum of the cylinder outer diameter $D_{co}$ and a total thickness of the wrapped media sheets 130.

Figure 2B:
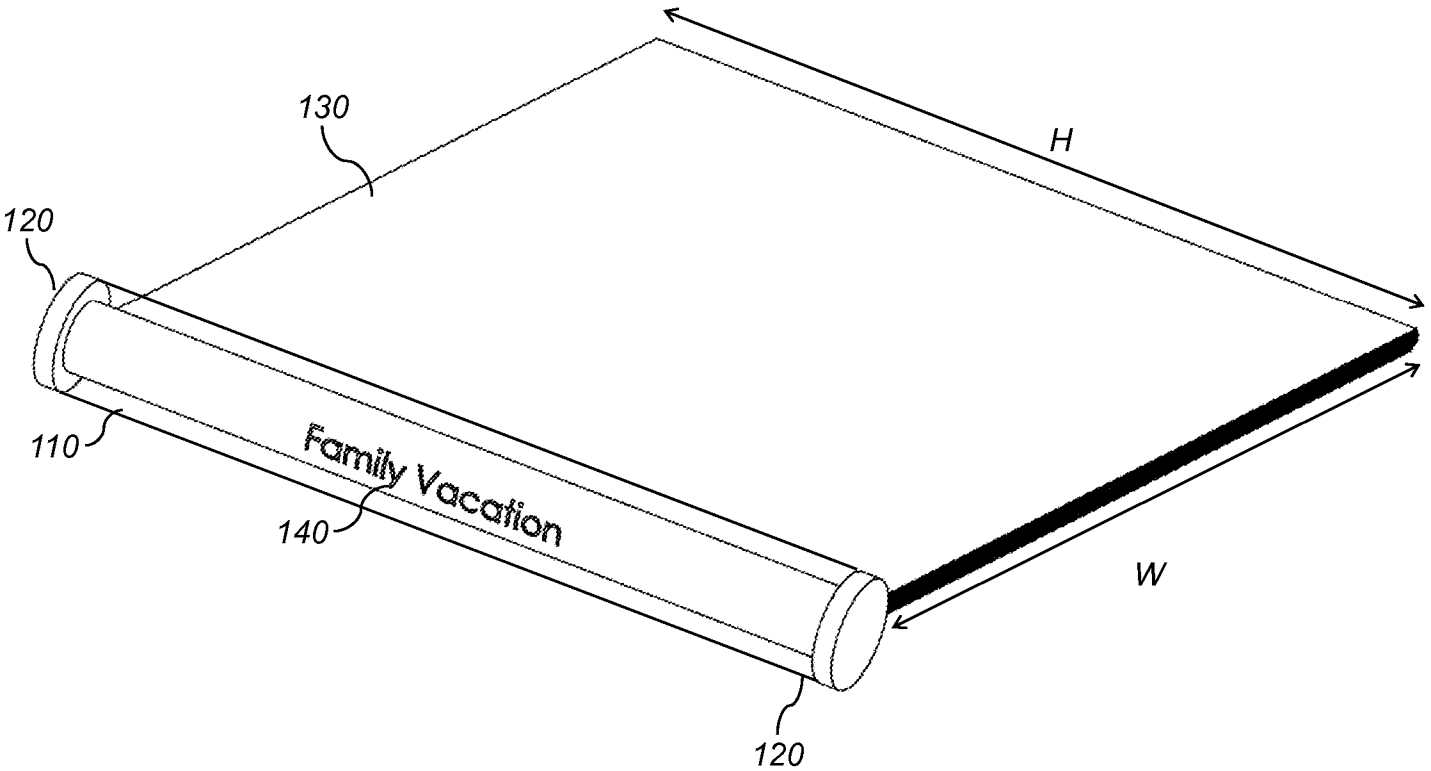
FIG. 2B shows the components of the binding system of FIG. 1 assembled to bind a set of sheets in a configuration using a transparent retainer.

Optionally, the binding system can include end caps 120 that cover the ends of the assembled cylinder 100 and retainer 110 (see FIGS. 1 and 2A-2B). In some embodiments, the end caps 120 include posts 125 and are adapted to be attached to the ends of the cylinder 100 by inserting the posts 125 into the hollow core 105 of the cylinder 100. Preferably, the posts 125 are sized to fit snuggly within the hollow core 105 so that they will not fall out. In some embodiments, the posts 125 are tapered such that the ends of the posts 125 have a diameter that is smaller than the cylinder inner diameter $D_{ci}$, thereby enabling them to be more easily inserted into the hollow core 105. In some embodiments, the posts 125 can include retaining features (e.g., serrations) that are adapted to engage with the hollow core 105. Any type of retaining feature known in the art can be used in accordance with the present invention.

In some embodiments, a book title 140 can be provided on the spine of the bound book as illustrated in FIG. 2A. The book title 140 can be produced in a variety of different ways. For example, the book title 140 can be printed directly onto the retainer 110, or can be printed onto an adhesive label that can be affixed to the exterior of the retainer 110. FIG. 2B illustrates an alternate configuration where the retainer 110 is fabricated using a transparent material and the book title 140 is printed on the portion of the top-most media sheet 130 that is wrapped around the cylinder 100 (FIG. 1) to position it so that it will be visible through the retainer 110.

Figure 5:
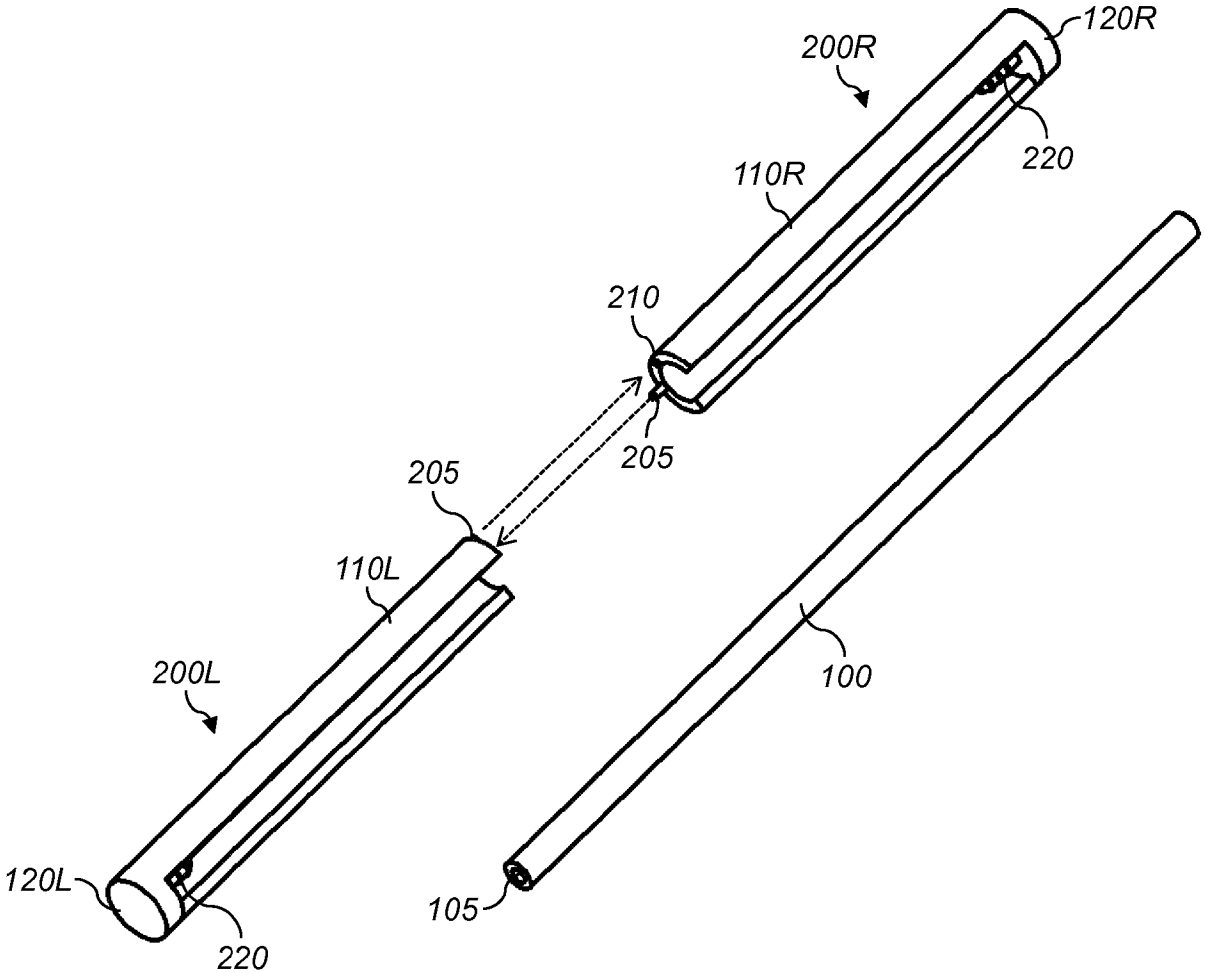
FIG. 5 shows the components of a binding system according to a second embodiment.
Figure 6:
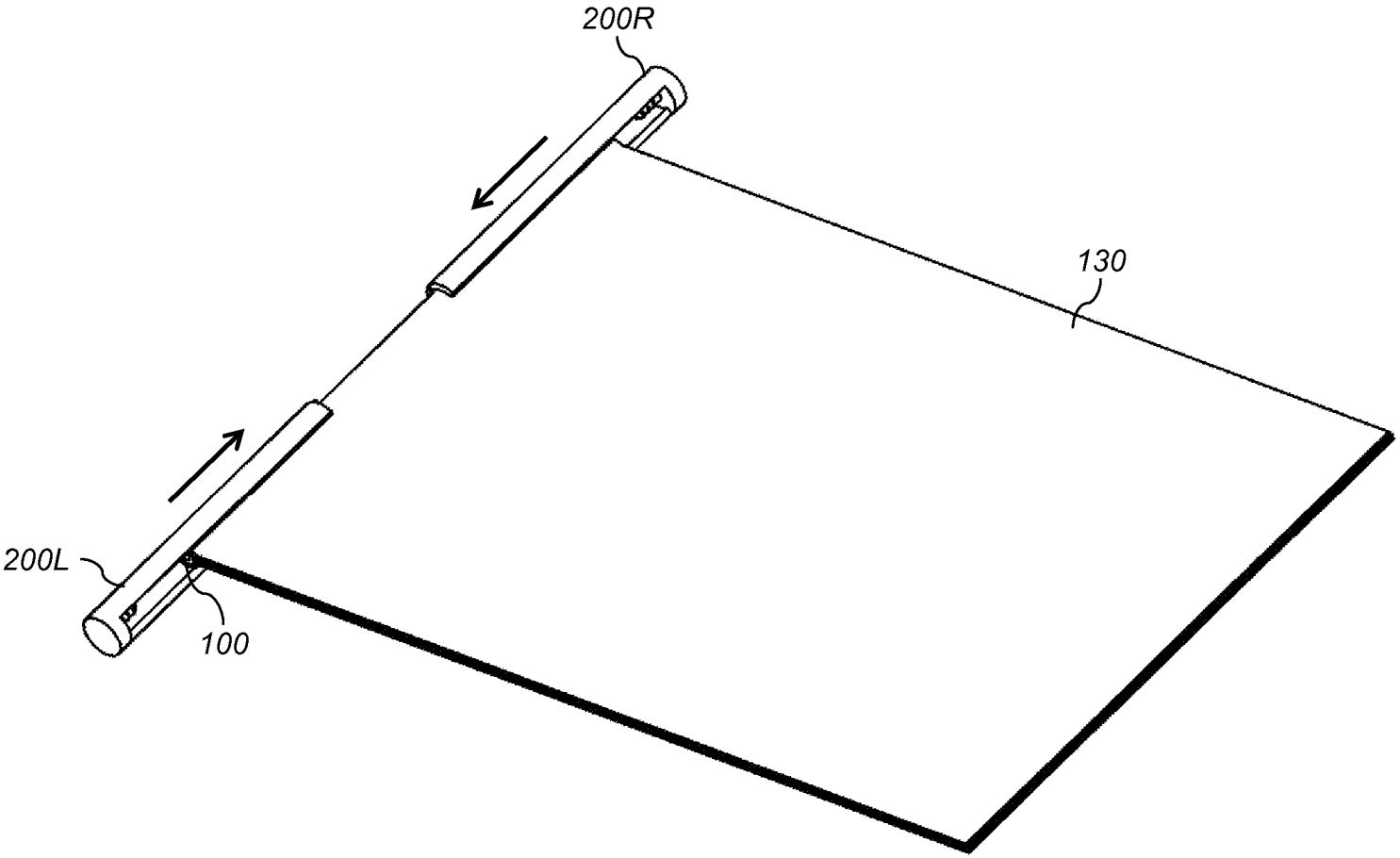
FIG. 6 shows the components of the binding system of FIG. 5 partially assembled to bind a set of sheets.

FIGS. 5-6 illustrate a binding system according to a second embodiment present invention. In this case, the retainer 110 of FIG. 1 is replaced with two pieces: a left retainer piece 200L and a right retainer piece 200R. The left retainer piece 200L includes a left retainer half 110L in combination with a left end cap 120L. Similarly, the right retainer piece 200R includes a right retainer half 110R in combination with a right end cap 120R. The left retainer piece 200L and the right retainer piece 200R are preferably formed as single molded components. Alternately, the different portions (e.g., the left retainer half 110L and left end cap 120L) can be formed as individual pieces and can be joined together (e.g., using glue).

The left retainer piece 200L and the right retainer piece 200R are adapted to be joined together to form a complete retainer into which cylinder 100 (wrapped with media sheets 130) can be inserted as shown in FIG. 6. In some embodiments, the left retainer piece 200L and the right retainer piece 200R each include an alignment pin 205 and a corresponding hole 210 adapted to receive the alignment pin 205 on the other retainer piece in order to facilitate alignment of the two retainer pieces during assembly. By proper positioning of the alignment pin 205 and the hole 210, the left retainer piece 200L and the right retainer piece 200R can be identical to each other. This has the advantage that only one type of retainer piece needs to be manufactured.

In some embodiments, the left retainer piece 200L and the right retainer piece 200R include posts 220 that are adapted to be inserted into the hollow core 105 of the cylinder 100, thereby fastening the three pieces together. The posts 220 can include fastening features (e.g., serrations) that can be used to hold the pieces together. In some embodiments, the ends of the posts 220 are tapered such that the ends of the posts 220 have a diameter that is smaller than the cylinder inner diameter $D_{ci}$, thereby enabling them to be more easily inserted into the hollow core 105.

In some embodiments, the left retainer piece 200L and the right retainer piece 200R can include fastening features (e.g., clips) on the abutting surfaces that are adapted to fasten the pieces together (not shown in FIGS. 5 and 6). In this case, the posts 220 do not need to include any fastening features, and in some embodiments the posts 220 can be eliminated altogether.

In the embodiment shown in FIGS. 5-6, it is not crucial that the inner diameters $D_{ri}$ of the left retainer piece 200L and the right retainer piece 200R be selected to provide a clamping force F to bind the set of media sheets 130 and hold the pieces together. In this case, pieces are held together by the posts 220 that are inserted into the cylinder 100, and therefore the gap between the cylinder 100 and the retainer pieces can be slightly larger as long as there is sufficient friction to keep the media sheets from sliding out. In fact, it can be desirable for the gap to be larger in order to make it easier for the pieces to be assembled together.

Figure 7:
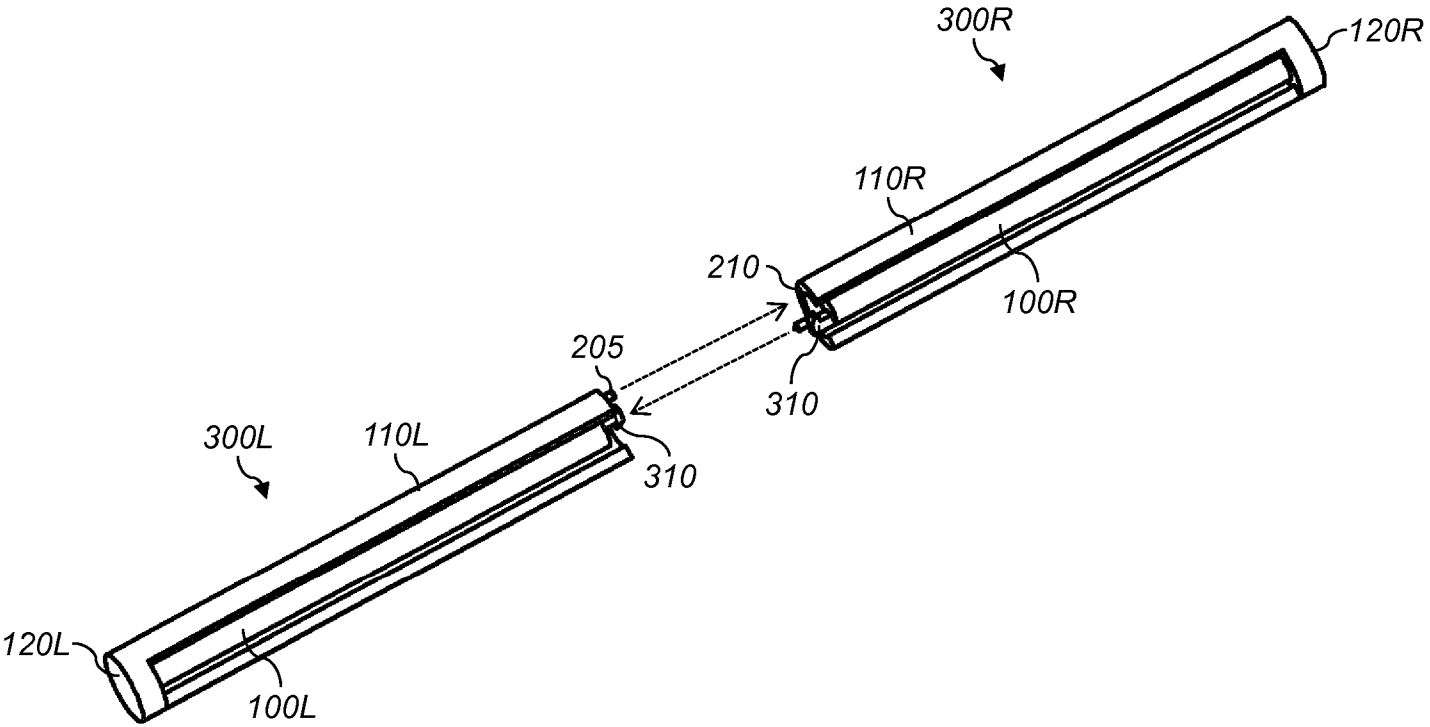
FIG. 7 shows the components of a binding system according to a third embodiment.
Figure 8:
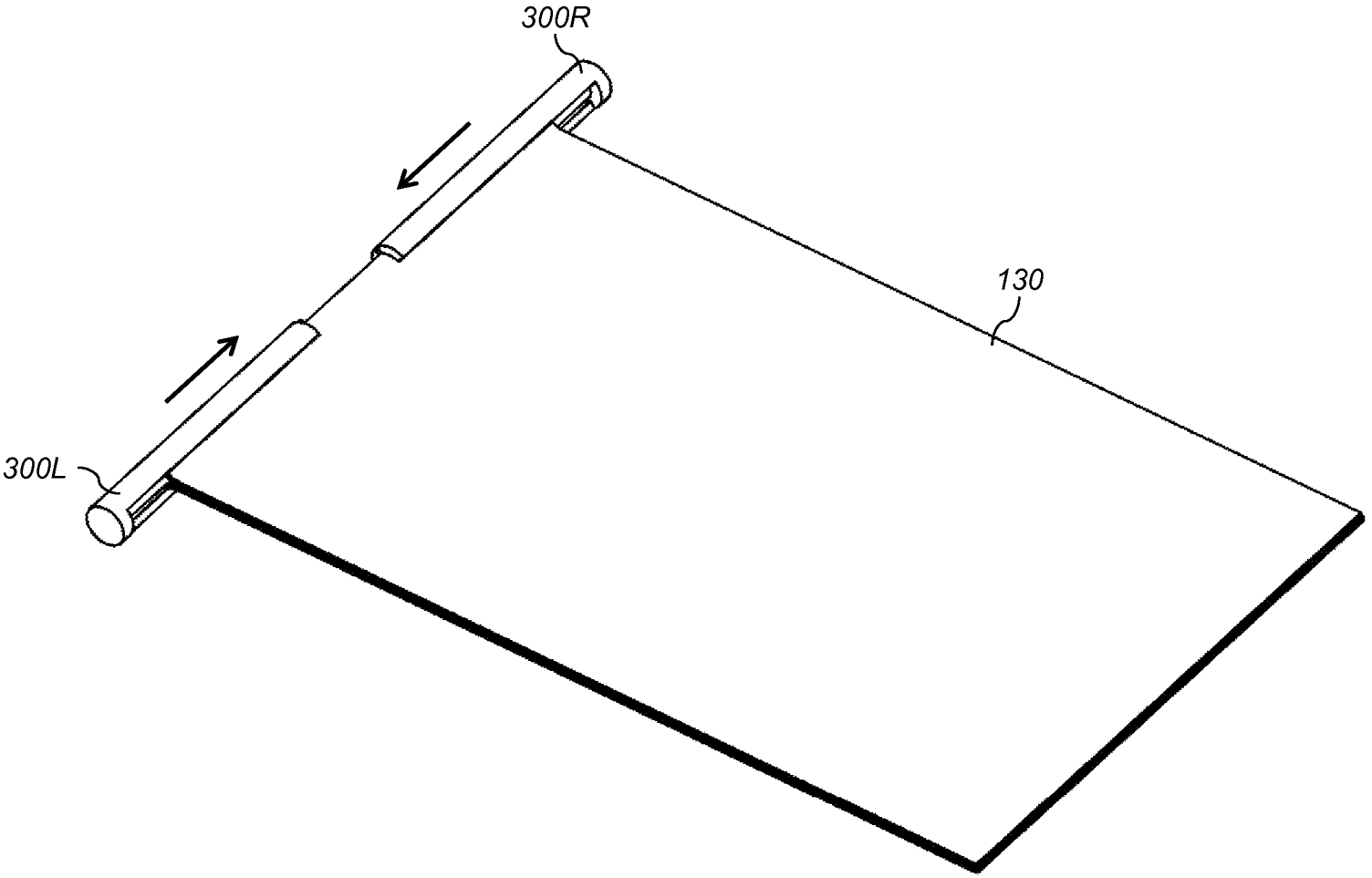
FIG. 8 shows the components of the binding system of FIG. 7 partially assembled to bind a set of sheets.

FIGS. 7-8 illustrate a binding system according to a third embodiment present invention. This embodiment is similar to the one that was discussed with respect to FIGS. 5-6 except that the cylinder 100 is replaced with two pieces: a left cylinder half 100L and a right cylinder half 100R, which are incorporated into left retainer piece 300L and right retainer piece 300R, respectively. The left retainer piece 300L and the right retainer piece 300R are preferably formed as single molded components. Alternately, the different portions (e.g., the left cylinder half 100L, the left retainer half 110L and the left end cap 120L) can be formed as individual pieces and can be joined together (e.g., using glue, heat stake, ultrasonic welding, or snap connections).

The left retainer piece 300L and the right retainer piece 300R are adapted to be connected together to form a complete binding system that can be used to bind media sheets 130 as shown in FIG. 8. To assemble the book, the media sheets 130 are doubled over forming a loop and an edge of the media sheets 130 on one end of the loop is inserted in the gap between the left cylinder half 100L and the left retainer half 110L of the left retainer piece 300L. The edge of the media pages on the opposite end of the loop is then inserted between the right cylinder half 100R and the right retainer half 110R of the right retainer piece 300R. The left retainer piece 300L and the right retainer piece 300R and then slid toward each other as shown in FIG. 8 and connected together to bind the media sheets 130 together, thereby forming a bound book.

In some embodiments, the left retainer piece 300L and the right retainer piece 300R each include an alignment pin 205 and a corresponding hole 210 adapted to receive the alignment pin 205 on the other retainer piece in order to facilitate alignment of the two retainer pieces during assembly. By positioning the alignment pin 205 and the hole 210 in appropriate complementary positions, the left retainer piece 300L and the right retainer piece 300R can be identical to each other. This has the advantage that only one type of retainer piece needs to be manufactured.

In some embodiments, the left retainer piece 300L and the right retainer piece 300R include connectors 310 that are adapted to snap together, thereby fastening the retainer pieces together. As the retainer pieces are pushed together, the connectors 310 flex slightly and slide past each other until the tabs slide past each other and snap into place, thereby preventing the retainer pieces from coming apart.

In some embodiments, the length of the left cylinder half 100L is substantially equal to the length of the left retainer half 110L and the length of the right cylinder half 100R is substantially equal to the length of the right retainer half 110R. In this case, when the two retainer pieces are assembled such that the left retainer half 110L is brought into contact with the right retainer half 110R, the left cylinder half 100L will also be in contact with the right cylinder half 100R. In other embodiments, the cylinder halves can be substantially shorter than the corresponding retainer halves. In this case, when the two retainer pieces are assembled, a gap will remain between the left cylinder half 100L and the right cylinder half 100R.

In a preferred embodiment, the left retainer piece 300L and the right retainer piece 300R are identical to each other. This has the advantage that only one type of retainer piece needs to be manufactured. To facilitate this, any alignment pins 205 and holes 210 should be placed in complementary positions, and the connectors 310 should be designed with appropriate symmetry.

In the embodiment shown in FIGS. 7-8 it is not crucial that the left retainer piece 300L inner diameters $D_{ri}$ of the left retainer piece 300L and the right retainer piece 300R be selected to provide a clamping force F to bind the set of media sheets 130 and hold the pieces together. In this case, pieces are held together by the connectors 310, and therefore the gap between the cylinder pieces and the retainer pieces can be slightly larger as long as there is sufficient friction to keep the media sheets from sliding out. In fact, it can be desirable for the gap to be larger in order to make it easier for the pieces to be assembled together.

Figure 9:
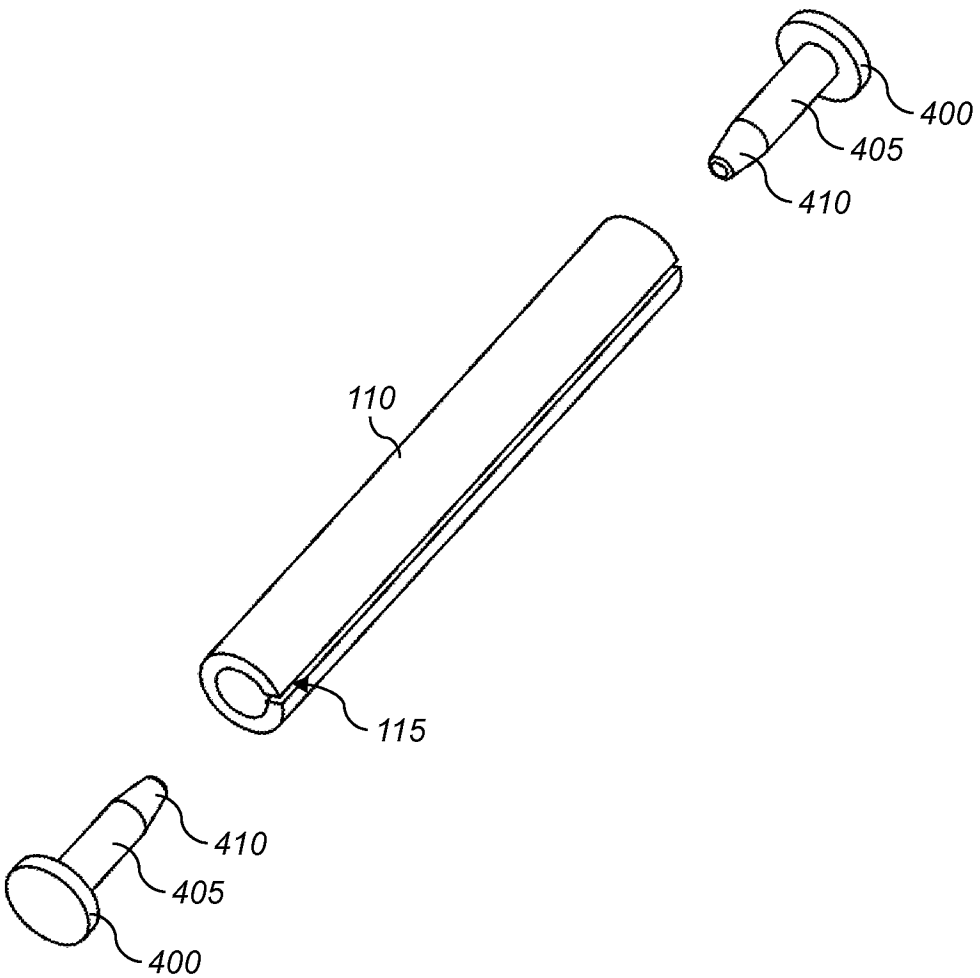
FIG. 9 shows the components of a binding system according to a fourth embodiment.
Figure 10:
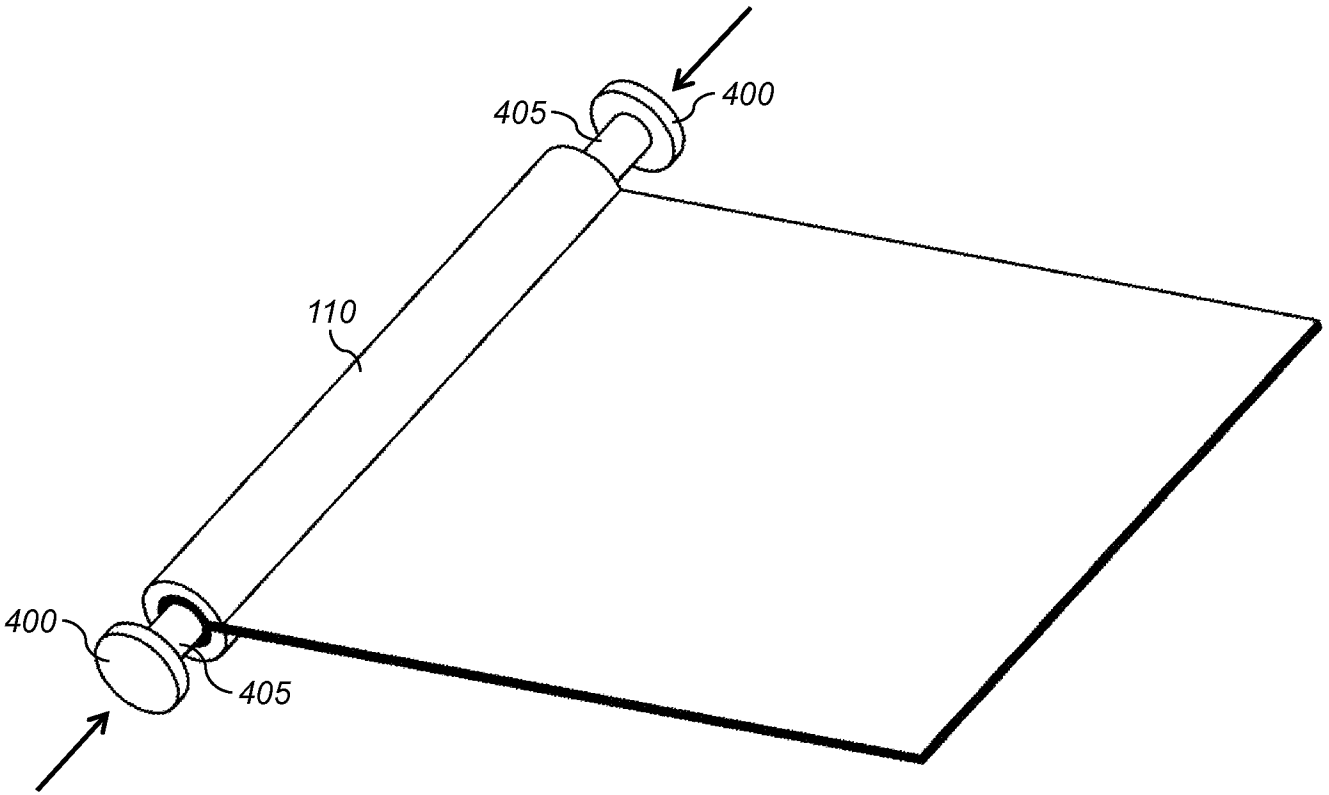
FIG. 10 shows the components of the binding system of FIG. 9 partially assembled to bind a set of sheets.

FIGS. 9-10 illustrates a binding system according to a fourth embodiment present invention. In this case, the cylinder 100 of FIG. 1 is replaced with two end plugs 405 that are adapted to be inserted into the ends of the retainer 110. To assemble a book using this binding system, the media sheets 130 are doubled over forming a loop which is slid into the opening slot 115 of the retainer 110. The end plugs 405 are then inserted into the loops to firmly bind the media sheets 130 into the retainer 110.

In this case the retainer inner diameter $D_{ri}$ of the retainer 110 and the outer diameter of the end plugs 405 (i.e., cylinder outer diameter $D_{co}$) should be chosen according to the same considerations that were discussed earlier with respect to the FIG. 1 embodiment. Specifically, when the retainer 110 is in a relaxed state, the retainer inner diameter $D_{ri}$ should be somewhat less than the sum of the cylinder outer diameter $D_{co}$ of the end plugs 405 and a total thickness of the wrapped media sheets 130 so that the retainer 110 provides a clamping force F to bind the set of media sheets 130 when it is in a flexed position around the end plugs 405.

Preferably, the end plugs 405 have tapered ends 410 to facilitate easier insertion into the ends of the retainer 110. End caps 400 can be attached to the end plugs 405 to cover the ends of the retainer 110 when the end plugs 405 are fully inserted. In some embodiments, the end caps 400 and the end plugs 405 are formed together as single molded components. Alternately, the end caps 400 and the end plugs 405 can be formed as individual pieces and can be joined together (e.g., using glue).

The embodiment shown in FIGS. 9-10 has the advantage that only the length of the retainer 110 would need to be adjusted to produce a variety of different photo book sizes. The same end plugs 405 can be used independent of the book size, which reduces the number of different parts that need to be manufactured and inventoried. In some embodiments, a number of different retainers 110 having different lengths can be fabricated corresponding to common book sizes. In other embodiments, the retainer 110 can be cut to a custom length in accordance with the desired book size from a single supply of longer parts. This can further reduce the number of different parts that need to be manufactured and inventoried.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The invention has been described in detail with particular reference to certain preferred embodiments thereof, but it will be understood that variations and modifications can be effected within the spirit and scope of the invention.

PARTS LIST

100 cylinder
100L left cylinder half
100R right cylinder half
105 hollow core
110 retainer
110L left retainer half
110R right retainer half
115 opening slot
118 slot edge
120 end cap
120L left end cap
120R right end cap
125 post
130 media sheet
140 book title
200L left retainer piece
200R right retainer piece
205 alignment pin
210 hole
220 post
300L left retainer piece
300R right retainer piece
310 connector
400 end cap
405 end plug
410 tapered end
$D_{ci}$ cylinder inner diameter
$D_{co}$ cylinder outer diameter
$D_{ri}$ retainer inner diameter
$D_{ro}$ retainer outer diameter
F clamping force
H book page height
$L_c$ cylinder length
$L_r$ retainer length
W book page width
$W_s$ slot width
$\theta_r$ retainer arc angle

The invention claimed is:

1. A binding system, comprising:

a cylinder having an outer diameter and a length; and a retainer having an arc-shaped cross-section fabricated from a flexible material, the arc-shaped cross-section having an inner diameter and an associated arc angle of at least 200 degrees and less than 360 degrees thereby providing an opening slot that extends along a length of the retainer;

wherein the cylinder and the retainer are adapted to bind a set of media sheets by wrapping the media sheets around the cylinder and inserting the wrapped cylinder into the retainer with the wrapped media sheets extending out of the opening slot in the retainer;

and wherein the retainer flexes to provide a clamping force to bind the set of media sheets when the wrapped cylinder is inserted into the retainer;

further including at least one end cap adapted to be attached to an end of the cylinder or the retainer thereby covering the end of the retainer, wherein the end cap includes a post and the cylinder has at least one hollow end such that the end cap can be attached to the cylinder by inserting the post into the hollow end of the cylinder.

2. The binding system of claim 1 wherein the inner diameter of the retainer, when it is in a relaxed state, is less than the sum of the outer diameter of the cylinder and a total thickness of the wrapped media sheets.

3. The binding system of claim 1 wherein the length of the retainer is substantially equal to the length of the cylinder.

4. The binding system of claim 1 wherein a height of the media sheets is substantially equal to the length of the cylinder.

5. The binding system of claim 1 wherein two ends of each media sheet extend out of the opening slot in the retainer.

6. The binding system of claim 5 wherein the two ends of each media sheet that extend out of the opening slot in the retainer have substantially the same length.

7. The binding system of claim 1 wherein only one end of each media sheet extends out of the opening slot in the retainer.

8. The binding system of claim 1 wherein the post has a tapered end.

9. A binding system, comprising:

a cylinder having an outer diameter and a length; and a first retainer having an arc-shaped cross-section fabricated from a flexible material, the arc-shaped cross-section having an inner diameter and an associated arc angle of at least 200 degrees and less than 360 degrees thereby providing an opening slot that extends along a length of the retainer;

a second retainer having the same arc-shaped cross-section as the first retainer;

wherein the cylinder and the retainer are adapted to bind a set of media sheets by wrapping the media sheets around the cylinder and inserting the wrapped cylinder into the retainer with the wrapped media sheets extending out of the opening slot in the retainer;

wherein the retainer flexes to provide a clamping force to bind the set of media sheets when the wrapped cylinder is inserted into the retainer; and wherein one portion of the cylinder is adapted to be inserted into the first retainer and a remaining portion of the cylinder is adapted to be inserted into the second retainer.

10. The binding system of claim 9 wherein the first retainer and the second retainer include at least one alignment pin and one hole adapted to receive the alignment pin from the other retainer to facilitate properly aligning the first retainer and the second retainer with each other.

11. The binding system of claim 9 wherein the first retainer and the second retainer include connectors on abutting surfaces adapted to connect the first retainer and the second retainer together.

12. The binding system of claim 9 wherein the first retainer and the second retainer each include an end cap to enclose a respective end.

13. The binding system of claim 12 wherein the end caps each include a post and the cylinder has hollow ends such that the first retainer and the second retainer can be attached to the cylinder by inserting the post on the corresponding end cap into the hollow ends of the cylinder.

14. The binding system of claim 1 further including a text label printed onto the retainer or printed onto an adhesive label that is adhered to the exterior of the retainer.

15. The binding system of claim 1 wherein the retainer is fabricated from a transparent material, and wherein a text label is printed onto the outer-most wrapped media sheet in a position where it is visible through the transparent retainer.

* * * * *